US011081817B2

(12) United States Patent
Fujisaki

(10) Patent No.: US 11,081,817 B2
(45) Date of Patent: Aug. 3, 2021

(54) CONNECTOR HAVING TERMINALS WITH BENT PORTIONS

(71) Applicant: Sumitomo Wiring Systems, Ltd., Mie (JP)

(72) Inventor: Ryuichi Fujisaki, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/787,109

(22) Filed: Feb. 11, 2020

(65) Prior Publication Data

US 2020/0259276 A1 Aug. 13, 2020

(30) Foreign Application Priority Data

Feb. 11, 2019 (JP) ..... JP2019-022192

(51) Int. Cl.

| | |
|---|---|
| ***H01R 11/12*** | (2006.01) |
| ***H01R 25/00*** | (2006.01) |
| ***H01R 13/621*** | (2006.01) |
| ***H01R 33/06*** | (2006.01) |
| *H01R 103/00* | (2006.01) |

(52) U.S. Cl.

CPC ..... *H01R 11/12* (2013.01); *H01R 13/6215* (2013.01); *H01R 25/006* (2013.01); *H01R 33/06* (2013.01); *H01R 2103/00* (2013.01)

(58) Field of Classification Search

CPC .... H01R 13/648; H01R 4/70; H01R 13/5845; H01R 13/41

See application file for complete search history.

(56) References Cited

U.S. PATENT DOCUMENTS

| | | | | |
|---|---|---|---|---|
| 6,815,610 | B2 * | 11/2004 | Kuboshima | H01R 13/5845 174/360 |
| 8,192,212 | B2 * | 6/2012 | Casses | B60L 53/16 439/181 |
| 8,545,265 | B2 * | 10/2013 | Sakamoto | B29C 45/14467 439/606 |
| 8,905,770 | B2 * | 12/2014 | Fujiwara | H01R 13/516 439/181 |
| 9,960,531 | B2 * | 5/2018 | Poncini | H01R 13/502 |
| 2004/0057187 | A1 * | 3/2004 | Kuboshima | H01R 13/5845 361/118 |

(Continued)

FOREIGN PATENT DOCUMENTS

JP 2012-104415 5/2012

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A connector (1) includes a housing (2) and first and second terminals (31, 32). One end of each terminal (31, 32) is inserted into the housing (2) and the other end thereof projects from the housing (2). Each terminal (31, 32) includes a base (33) projecting from the housing (2) and a connecting portion (34) that is wider than the base (33) toward both sides in a (Y) direction. The connecting portion (34) of the first terminal (31) projects farther from the housing (2) than the connecting portion (34) of the second terminal (32) in an (X) direction. The base (33) includes a flat plate (330) having a thickness in a (Z) direction. A side part of the base (33) of the first terminal (31) adjacent to the connecting portion (34) of the second terminal 32 in the (Y) direction is bent with respect to the flat plate (330).

3 Claims, 10 Drawing Sheets

(56) References Cited

U.S. PATENT DOCUMENTS

| | | | | |
|---|---|---|---|---|
| 2017/0194738 | A1* | 7/2017 | Poncini | H01R 4/029 |
| 2020/0259276 | A1* | 8/2020 | Fujisaki | H01R 25/006 |
| 2020/0259284 | A1* | 8/2020 | Fujisaki | H01R 4/70 |

* cited by examiner

CONNECTOR HAVING TERMINALS WITH BENT PORTIONS

BACKGROUND

Field of the Invention

This disclosure relates to a connector.

Related Art

Japanese Unexamined Patent Publication No. 2012-104415 discloses a connector with two cavities capable of accommodating two terminals for supplying power to an in-vehicle device. A locking lance projects from an inner wall of the cavity and engages the terminal inserted into the cavity to prevent the terminal from coming out from the housing.

In a connector 9 described in FIG. 10 of Japanese Unexamined Patent Publication No. 2012-104415 shows a connector 9 with two terminals 91. One end of each terminal 91 shown in FIG. 10 is inserted into a cavity and the other end projects out from the housing. A connecting portion 911 is formed on a projecting end part of the terminal 91 is widened to project toward both sides in an arrangement direction of the terminals 91. The projecting end part of the terminal 91 includes a bolt inserting portion 912. The terminal 91 is connected to another conductive member by inserting a bolt through the bolt inserting portion 912.

The connecting portions 911 of the two terminals 91 shown in FIG. 10 may be too close to each other in the arrangement direction Y when accuracy in mounting the terminals 91 into the housing 92 or the molding accuracy of the housing 92 is low. Thus, there is room for improvement in terms of ensuring electrical insulation between the terminals 91.

The terminals 91 could be positioned farther apart in the arrangement direction Y to ensure insulation between the terminals 91. However, moving the terminals 91 farther apart in the arrangement direction Y enlarges the connector 9. Reducing a width of each terminal 91 in the arrangement direction Y could increase an interval between the terminals without enlarging the connector 9. However, an electrical resistance value of each terminal 91 may increase as a cross-sectional area of the terminal 91 decreases.

This disclosure was made in view of such a problem and aims to provide a connector capable of ensuring electrical insulation between two terminals without enlarging the connector and without increasing an electrical resistance value of each terminal.

SUMMARY

One aspect of this disclosure is directed to a connector with a housing, and first and second terminals disposed side by side to be parallel to each other. One end of each of the first and second terminals is inserted into the housing while the other end thereof projects from the housing. Each of the first and second terminals includes a base projecting from the housing and a connecting portion that is wider than the base toward both sides in an arrangement direction of the first and second terminals. The connecting portion includes a bolt inserting portion. The connecting portion of the first terminal is farther from the housing than the connecting portion of the second terminal. The base includes a flat plate having a thickness in a direction orthogonal to both the arrangement direction of the first and second terminals and the terminal forming direction along the first and second terminals. A side part of the base of the first terminal adjacent to the connecting portion of the second terminal in the arrangement direction is bent with respect to the flat plate.

The connecting portions of the first and second terminals are at positions deviated from each other in the terminal forming direction. Thus, the two connecting portions can be prevented from being too close to each other, which would occur if the connecting portions were side-by-side in the arrangement direction. In this way, electrical insulation between the first and second terminals is ensured.

As described above, an interval between outer sides of the first and second terminals in the arrangement direction (i.e. a length in the arrangement direction from an end part of the first terminal opposite to the second terminal to an end part of the second terminal opposite to the first terminal) can be reduced by forming the connecting portions of the first and second terminals at positions deviated from each other in the terminal forming direction. However, this approach also brings the connecting portion of the second terminal closer the base of the first terminal in the arrangement direction, and electrical insulation between the first and second terminals may be reduced.

Accordingly, the side part of the base of the first terminal adjacent to the connecting portion of the second terminal in the arrangement direction is bent with respect to the flat plate. In this way, an interval between the connecting portion of the second terminal and the base of the first terminal in the arrangement direction is secured without increasing the interval between outer sides of the first and second terminals. Thus, insulation between the terminals is ensured without enlarging the connector. Further, the base of the first terminal can be formed by bending without reducing a cross-sectional area orthogonal to the terminal forming direction. Therefore, an increase in an electrical resistance value of the entire first terminal is avoided.

As described above, the connector ensures electrical insulation between two terminals without enlarging the connector or increasing an electrical resistance value of each terminal.

DETAILED DESCRIPTION

First Embodiment

An embodiment of a connector is described using FIGS. 1 to 8.

Figure 1:
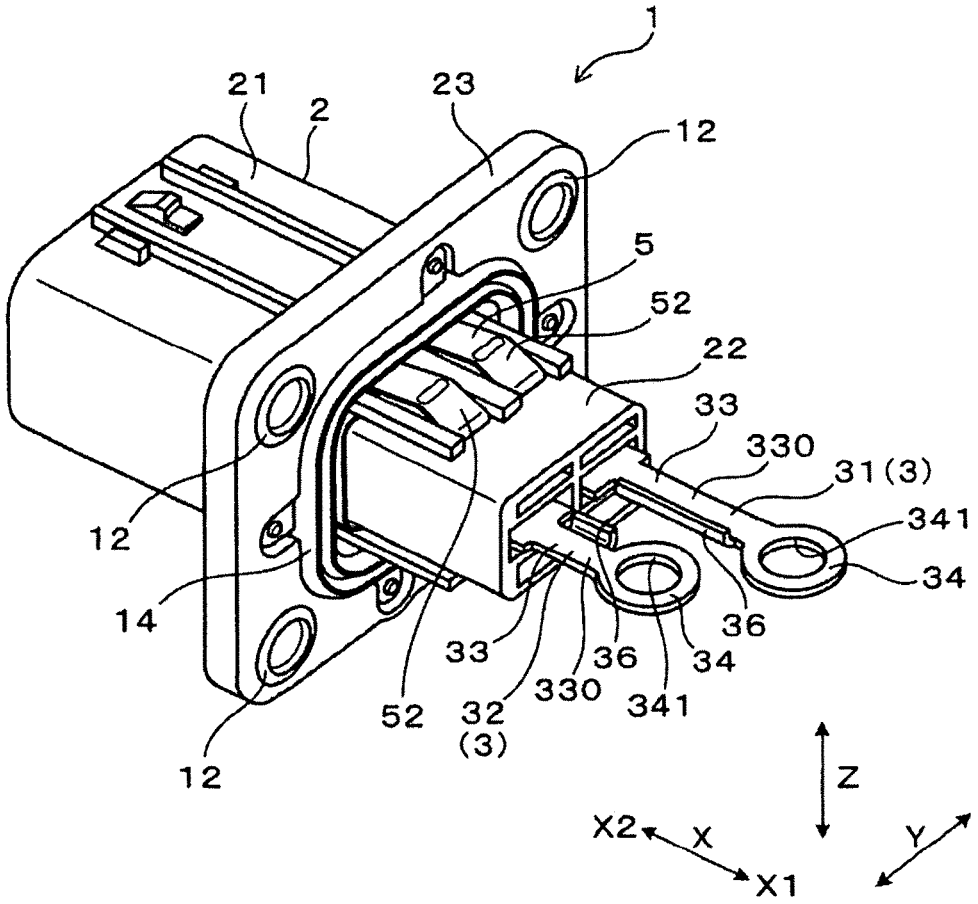
FIG. 1 is a perspective view of a connector in a first embodiment.
Figure 2:
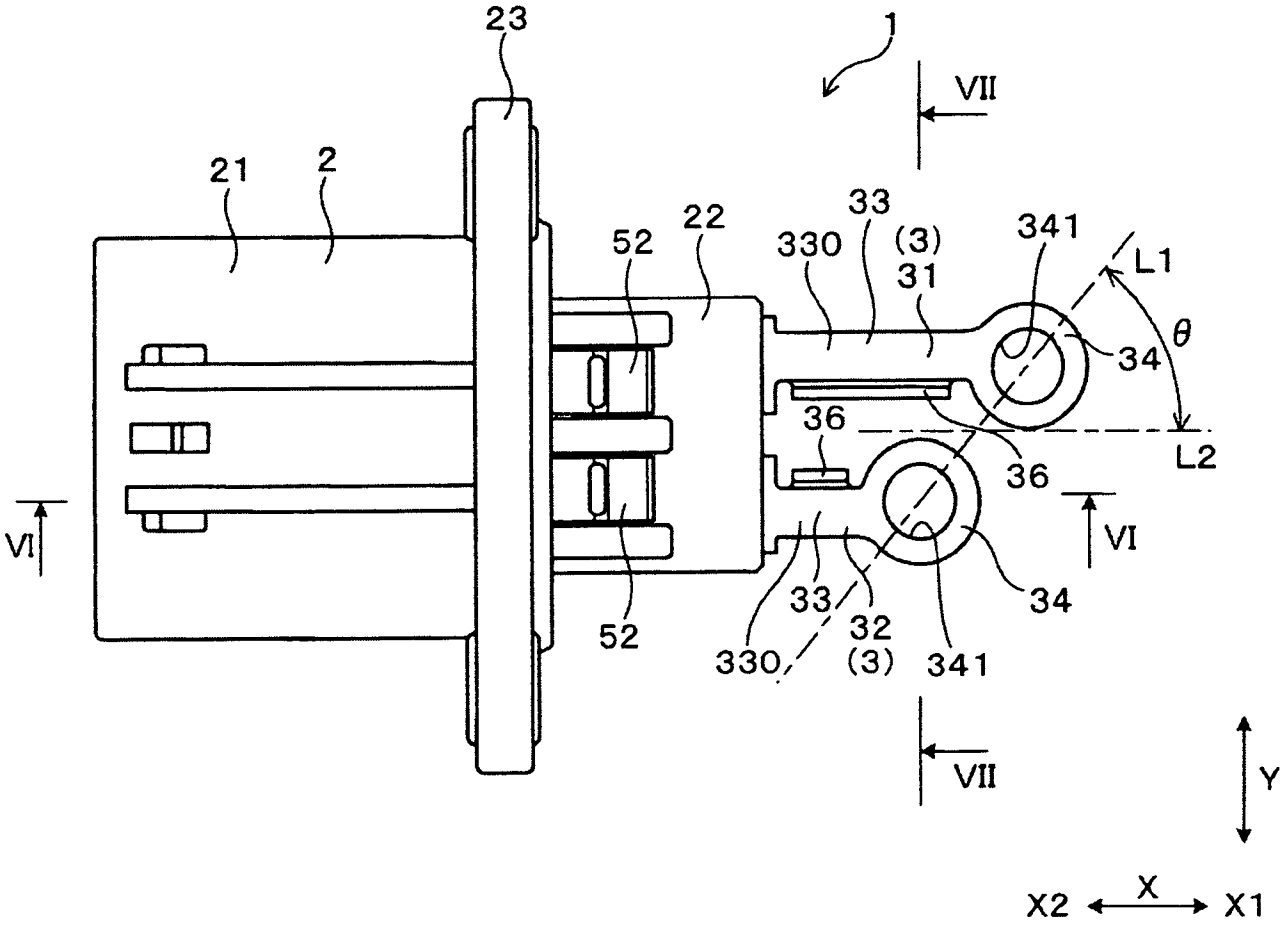
FIG. 2 is a plan view of the connector in the first embodiment.
Figure 5:
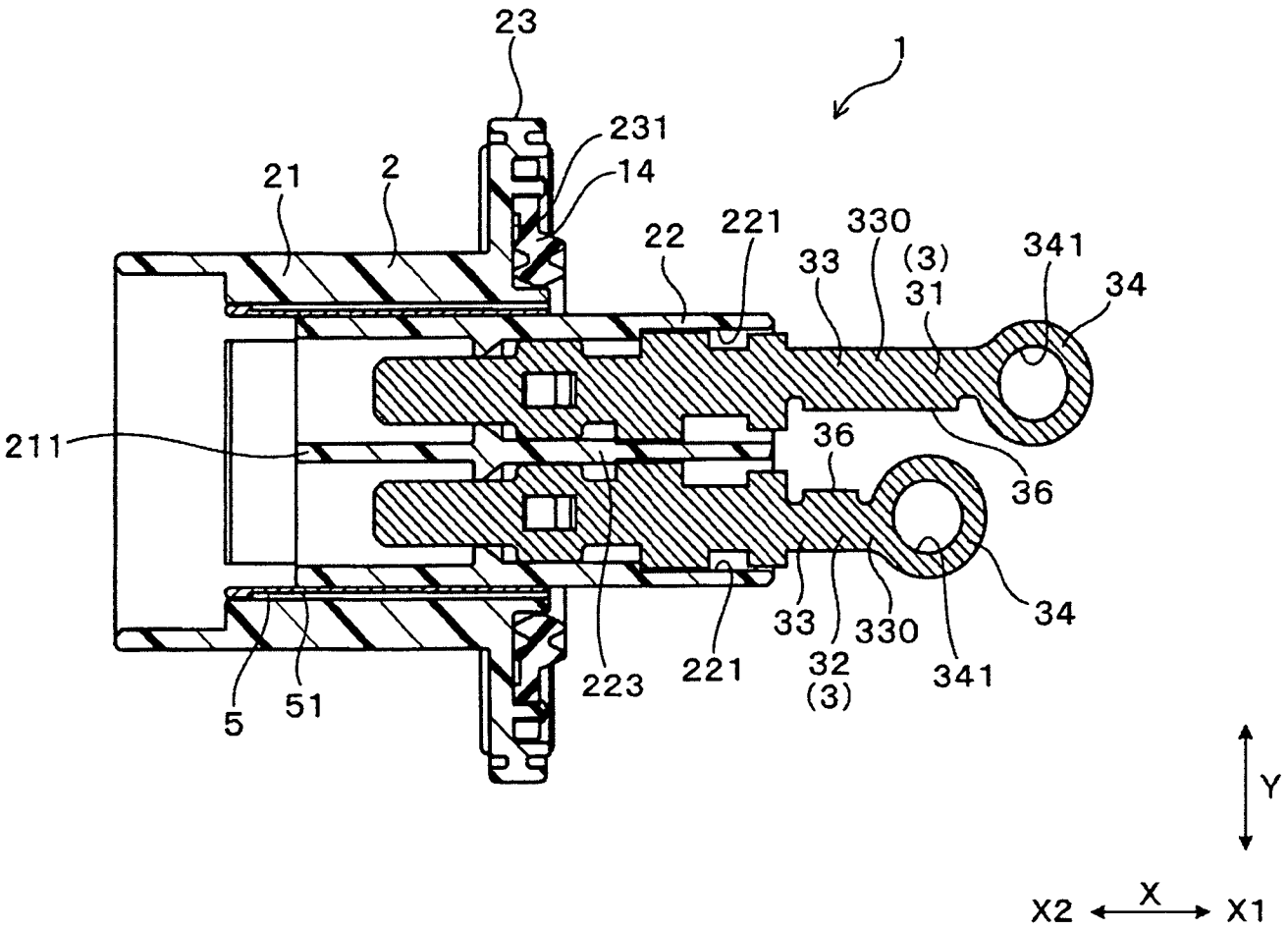
FIG. 5 is a section along V-V of FIG. 3.

A connector 1 of this embodiment includes a housing 2, a first terminal 31 and a second terminal 32, as shown in FIGS. 1, 2 and 5.

The first and second terminals 31, 32 are disposed side by side to be parallel to each other. One end side of each of the first and second terminals 31, 32 is inserted into the housing 2 and the other end side thereof projects from the housing 2.

Each of the first and second terminals 31, 32 includes a base 33 and a connecting portion 34. The base 33 projects from the housing 2. The connecting portion 34 is wider than the base 33 toward both sides in an arrangement direction of the first and second terminals 31, 32 (hereinafter, referred to as a "Y direction") and has a bolt inserting portion.

The connecting portion 34 of the first terminal 31 projects farther from the housing 2 than the connecting portion 34 of the second terminal 32 in a terminal forming direction (hereinafter, referred to as an "X direction") along the first and second terminals 31, 32.

The base portion 33 includes a flat plate 330 in the form of a flat plate having a thickness in a direction orthogonal to both the Y direction and the X direction (hereinafter, referred to as a "Z direction"). The base 33 of the first terminal 31 is shaped such that a side part (bent portion 36 to be described later) on a side adjacent to the connecting portion 34 of the second terminal 32 in the Y direction is bent with respect to the flat plate 330.

In this embodiment, the first and second terminals 31, 32 may collectively be called terminals 3 unless otherwise noted. An end toward which the first and second terminals 31, 32 project from the housing 2 in the X direction is referred to as an X1 end and an opposite end thereof is referred to as an X2 end. A radial direction of the connector 1 centered on a center axis of the connector 1 extending in the X direction merely is referred to as a radial direction. A center axis area of the connector 1 in the radial direction is referred to as an inner peripheral side, and an opposite side thereof is referred to as an outer peripheral side.

[Connector 1]

Figure 6:
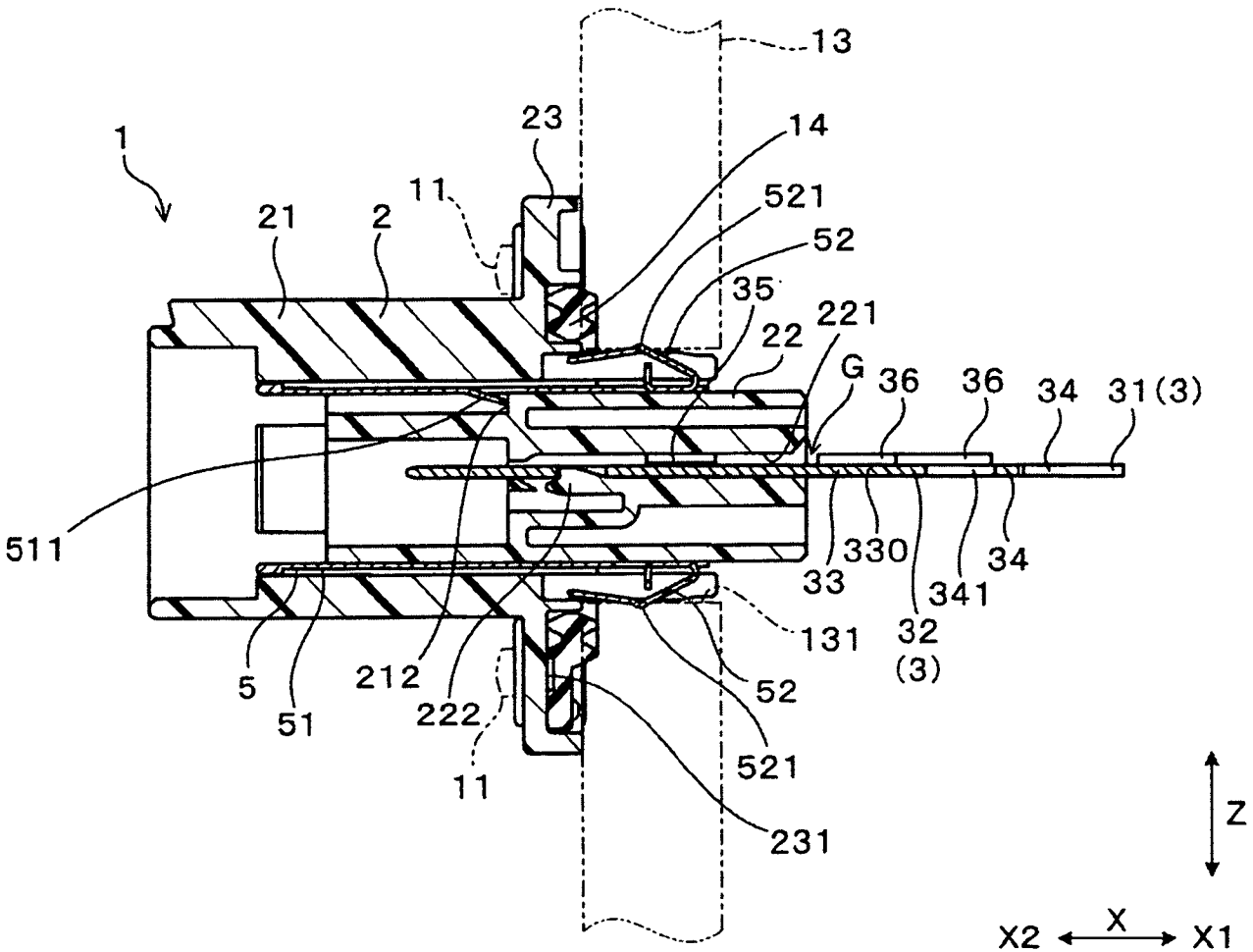
FIG. 6 is a section along VI-VI of FIG. 2.

As shown in FIG. 6, the connector 1 is mounted directly on a case 13 of an electrical device to be installed in an electric vehicle or the like and can relay electrical connection between an external power supply and a component disposed in the case 13.

[Housing 2]

Figure 3:
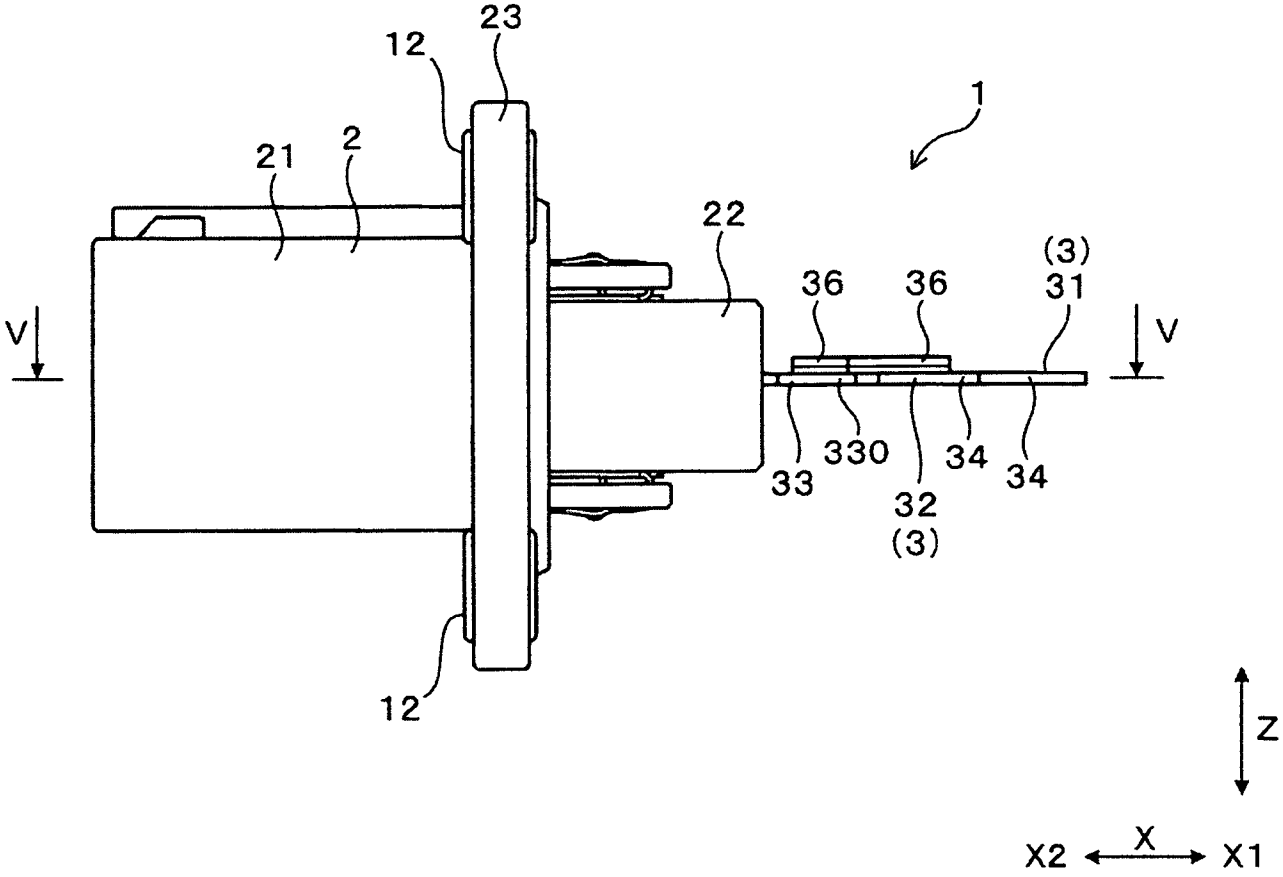
FIG. 3 is a side view of the connector in the first embodiment.

The housing 2 is made of resin having electrical insulation. As shown in FIGS. 1 to 3, the housing 2 includes a mounting portion 21, a terminal inserting portion 22 and a flange 23.

As shown in FIGS. 1-3, 5 and 6, the mounting portion 21 has a tubular shape parallel to the X direction. The mounting portion 21 is formed in an X2 end region of the housing 2. As shown in FIG. 5, parts of the first and second terminals 31 and 32 on the X2 end are exposed inside the mounting portion 21. In other words, the mounting portion 21 covers the X2 ends of the first and second terminals 31 and 32 from the outer peripheral side. A first partition wall 211 is formed inside the mounting portion 21 and partitions between the X2 ends of the first and second terminals 31 and 32.

An internal space of the mounting portion 21 is open on the X2 end, and an unillustrated mating connector is fit into the mounting portion 21 from the X2 end. With the mating connector connected to the connector 1, the X2 ends of the first and second terminals 31, 32 exposed in the mounting portion 21 are connected electrically to terminals of the mating connector. The terminal inserting portion 22 projects toward the X2 end in the mounting portion 21.

As shown in FIG. 5, the terminal inserting portion 22 includes two cavities 221. The cavities 221 are holes that penetrate through the terminal inserting portion 22 in the X direction. X2 ends of the cavities 221 communicate with the internal space of the mounting portion 21. The two cavities 221 are formed side by side in the Y direction.

The cavities 221 are open on the X1 side, and the terminals 3 are inserted therein from the X1 end. Specifically, the first terminal 31 is inserted into one of the two cavities 221 and the second terminal 32 is inserted into the other.

As shown in FIG. 6, a locking lance 222 for retaining the terminal 3 is formed on a wall portion facing the cavity 221 in the Z direction in the housing 2. The locking lance 222 is formed to be long in the X direction, is cantilevered to project toward the X2 end, and is resiliently deflectable in the Z direction.

The terminal 3 is inserted into the cavity 221 while deflecting the locking lance 222 in the Z direction. When the terminal 3 is inserted to a predetermined position in the cavity 221, the locking lance 222 is inserted into a through hole formed in the terminal 3 due to a resilient restoring force. In this way, the locking lance 222 prevents the terminal 3 inserted to the predetermined position of the cavity 221 from coming out from the cavity 221.

As shown in FIG. 5, a second partition wall 223 is formed between the two cavities 221 and partitions between the two cavities 221 arranged in the Y direction. The second partition wall 223 is continuous with the first partition wall 211 in the X direction. As shown in FIGS. 1 to 3, 5 and 6, the flange 23 is formed on a boundary part between the mounting portion 21 and the terminal inserting portion 22 in the X direction.

Figure 4:
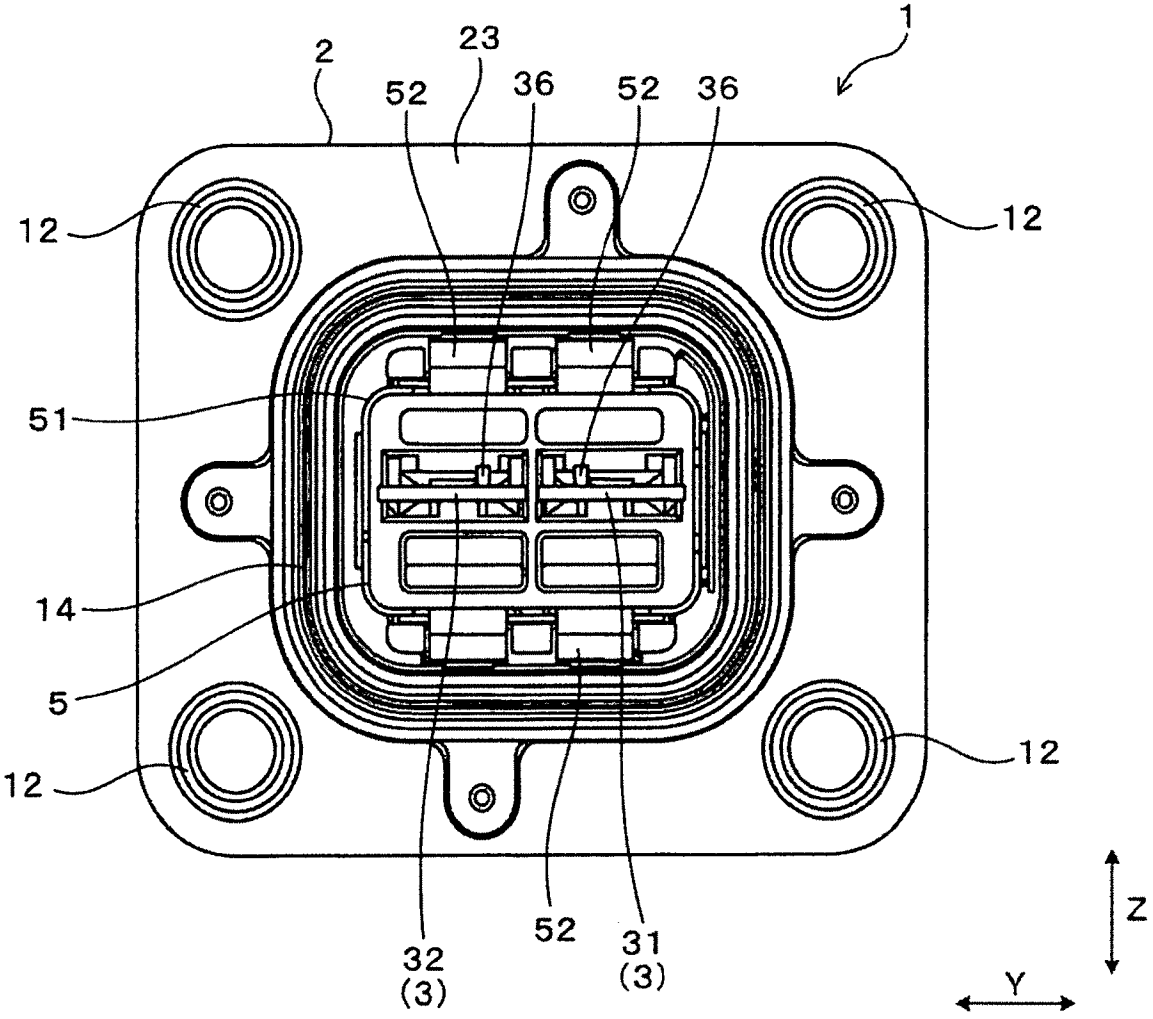
FIG. 4 is a back view of the connector in the first embodiment when viewed from the side of a terminal inserting portion in a housing.

The flange 23 projects more toward the outer peripheral side than the mounting portion 21 and the terminal inserting portion 22. As shown in FIGS. 1 and 4, metal collars 12 are embedded in four corners of the flange 23 and bolts 11 of FIG. 6 are inserted through the collars 12.

As shown in FIG. 6, the case 13 has an arrangement hole 131 larger than the terminal inserting portion 22 of the connector 1 and smaller than the flange 23. The terminal inserting portion 22 of the connector 1 is inserted into the arrangement hole 131 of the case 13, and an X1 end surface of the flange 23 faces the case 13 in the X direction. The bolts 11 are inserted into the collars 12 from the X2 side of the collars 12 and threadably engage screw holes in the case 13 to fix the connector 1 to the case 13.

As shown in FIGS. 5 and 6, the X1 end surface of the flange 23 is formed with an annular accommodation groove 231 on an inner peripheral side of the collars 12 on the four corners. The accommodation groove 231 is open toward the X1 end, and an annular sealing member 14 made of rubber or the like is accommodated inside. With the connector 1 fastened to the case 13 by the bolts 11, the sealing member 14 is compressed by axial forces of the bolts 11 and is held in close contact with both the accommodation groove 231 and the case 13. In this way, sealing between the connector 1 and the case 13 is ensured.

[Terminals 3]

The first and second terminals 31, 32 are to be connected to a positive electrode and a negative electrode of the power supply, and a potential difference between these is a high potential difference of, e.g. about 600 V. As shown in FIG. 5, the first terminal 31 is inserted in one cavity 221 and the second terminal 32 is inserted in the other cavity 221. Substantially the entire terminal 3 is a plate having a thickness in the Z direction and long in the X direction. The first terminal 31 is longer than the second terminal 32.

Figure 8:
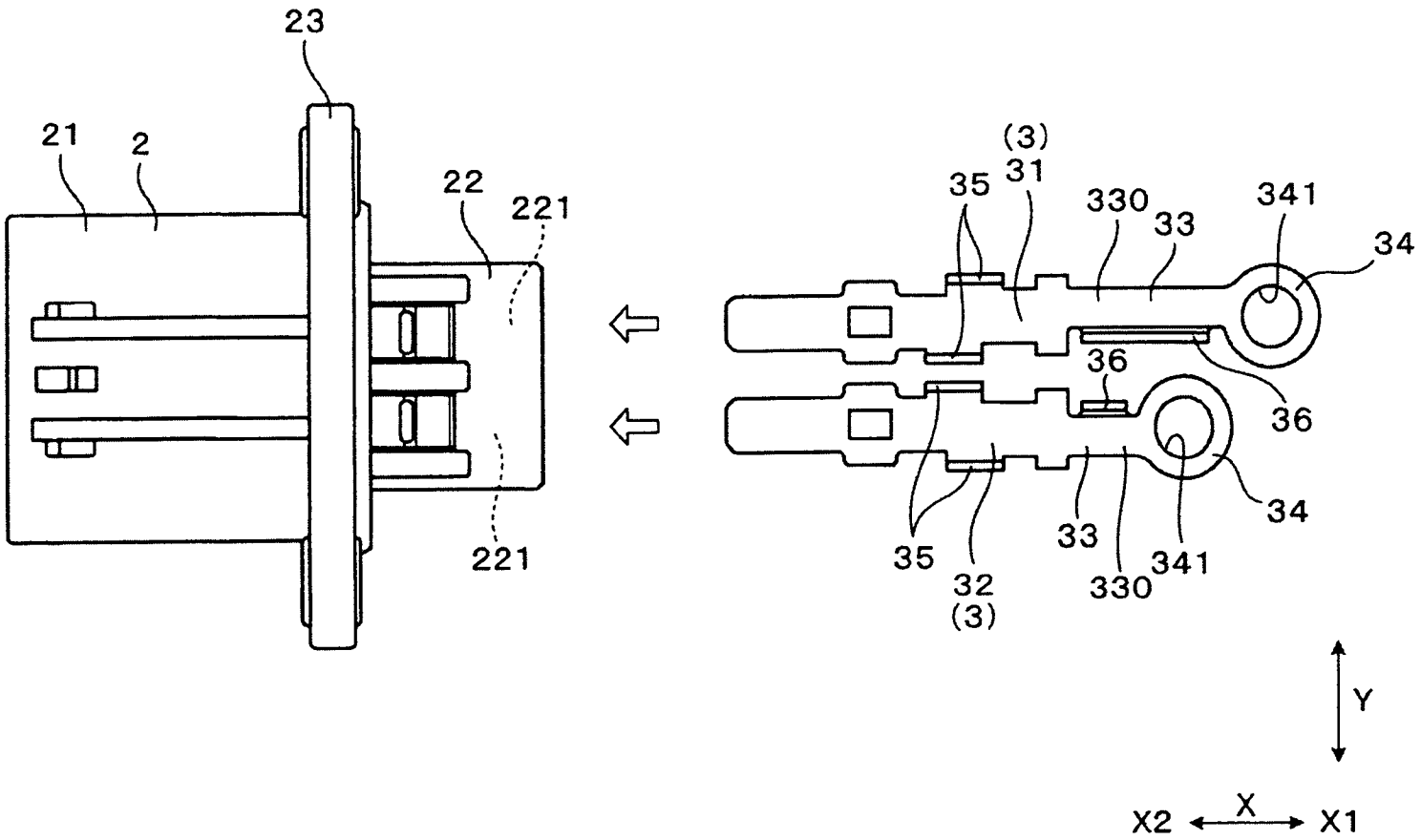
FIG. 8 is a plan view showing a state where terminals are being inserted into the housing in the first embodiment.

As shown in FIG. 8, the first and second terminals 31, 32 are inserted into the cavities 221 in the X direction from the X1 end. As shown in FIG. 5, X1 ends of these terminals project into the mounting portion 21. The positions of the X2 ends of the first and second terminal 31 and 32 are aligned in the X direction.

As shown in FIGS. 6 and 8, positioning portions 35 are formed on parts of the first and second terminals 31, 32 disposed in the cavities 221. The positioning portions 35 project more toward both sides in the Y direction than surrounding parts and are bent toward in the Z direction. The positioning portions 35 position the terminals 3 with respect to the cavities 221.

As shown in FIG. 5, an X1 end of each of the first and second terminals 31, 32 projects from the cavity 221 toward the X1 end. The first terminal 31 projects more in the X direction from the cavity 221 than the second terminal 32. Thus, the position of an X1 end of the first terminal 31 is closer to the X1 end than that of an X1 end of the second terminal 32.

A part of each of the first and second terminals 31, 32 projecting from the cavity 221 includes the base 33 and the connecting portion 34 successively from the X2 side. The base 33 is a rectangular plate long in the X direction and having a thickness in the Z direction, and the bent portion 36 bent in the Z direction from the flat plate 330.

As shown in FIGS. 1 and 2, the bent portion 36 of the first terminal 31 is bent toward one side in the Z direction from an end of the flat plate 330 of the first terminal 31 on the side of the second terminal 32 in the Y direction. The bent portion 36 of the second terminal 32 is bent toward one side in the Z direction from an end edge of the flat plate 330 of the second terminal 32 on the side of the first terminal 31 in the Y direction. The bent portions 36 of the first and second terminals 31, 32 are bent toward the same side to project toward the same side in the Z direction. A part of the flat plate 330 of the base 33 near a boundary part with the bent portion 36 projects more in the Y direction than surrounding parts, and the bent portion 36 is formed in the Z direction from this projecting part.

Figure 7:
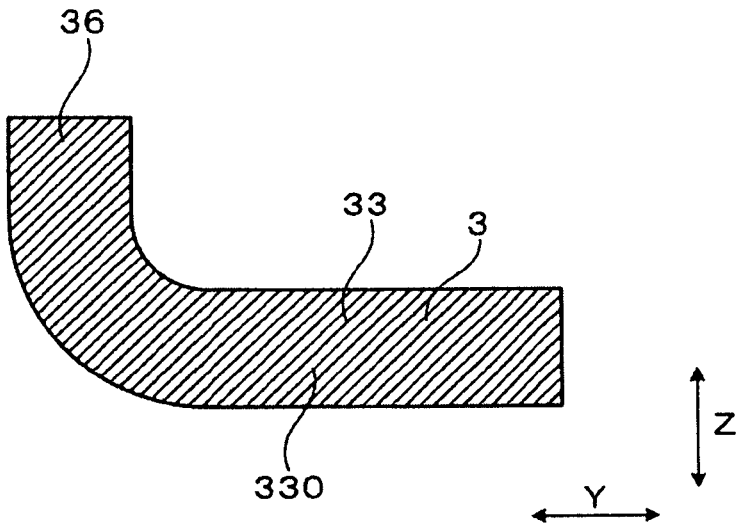
FIG. 7 is a section along VII-VII of FIG. 2 showing only a first terminal.

The first terminal 31 is bent only at a part of the base 33 on the side of the second terminal 32 in the Y direction, and the second terminal 32 is bent only at a part of the base 33 on the side of the first terminal 31 in the Y direction. In this way, as shown in FIG. 7, a region of the base 33 in the X direction where the bent portion 36 is formed has an L-shaped cross-section orthogonal to the X direction. At least a part of the first terminal 31 adjacent to the connecting portion 34 of the second terminal 32 in the Y direction has an L-shaped cross-sectional shape orthogonal to the X direction.

As shown in FIGS. 1 and 2, the bent portion 36 is formed substantially on the entire base 33 in the X direction. The base 33 of the first terminal 31 is longer than the base 33 of the second terminal 32 in the X direction and, accordingly, the bent portion 36 on the first terminal 31 is longer than the bent 36 on the second terminal 32 in the X direction. At least a part of the bent portion 36 on the first terminal 31 is formed at a position facing a part of the connecting portion 34 of the second terminal 32 projecting farthest in the Y direction toward the first terminal 31 in the Y direction.

As shown in FIG. 6, the bent portion 36 is disposed on the X1 side of the cavity 221. A gap G is formed between the bent portion 36 and the housing 2 in the Z direction. Specifically, the bent portion 36 is disposed at a position slightly away from the housing 2 toward the X1 side.

The bent portion 36 does not project more than the connecting portion 34 in the Y direction. Specifically, the bent portion 36 is located within a formation region of the connecting portion 34 in the Y direction.

The connecting portion 34 extends toward the X1 side from an X1 side end part of the flat plate portion 330. The connecting portion 34 is formed on the X1 side end part of the terminal 3. As shown in FIGS. 1 to 3 and 5, the connecting portion 34 is formed to be wider than the base portion 33 to project more toward both sides in the Y direction than the base portion 33. When viewed from the Z direction, the connecting portion 34 has a circular shape and includes the bolt inserting portion 341 penetrating through a central part of the connecting portion 34 in the Z direction. The terminal 3 is connected to another conductive member by an unillustrated bolt inserted into the bolt inserting portion 341.

The connecting portions 34 of the first and second terminals 31, 32 are at positions deviated from each other in the X direction. The connecting portion 34 of the first terminal 31 is at the position closer to the X1 end than the connecting portion 34 of the second terminal 32. In this way, the connecting portion 34 of the first terminal 31 and the connecting portion 34 of the second terminal 32 are formed side by side in a direction oblique to both the X direction and the Y direction. As shown in FIG. 2, a shortest virtual straight line L1 connecting the connecting portion 34 of the first terminal 31 and the connecting portion 34 of the second terminal 32 preferably is inclined so that an angle θ with respect to a virtual straight line L2 parallel to the Y direction is smaller than 45° (i.e. 45(π/180)rad). In this case, the connecting portion 34 of the first terminal 31 and the connecting portion 34 of the second terminal 32 can be relatively close without enlarging the connector 1.

The connecting portion 34 of the second terminal 32 is formed side by side with the base 33 of the first terminal 31 in the Y direction. The position of the X1 end of the second terminal 32 and that of the X2 end of the first terminal 31 are equivalent in the X direction.

[Shield Shell 5]

As shown in FIGS. 4 to 6, a shield shell 5 is disposed on an inner peripheral side of the sealing member 14 in the housing 2 and surrounds the first and second terminals 31, 32 over the entire periphery. The shield shell 5 includes a tubular shell body 51 and resilient contact pieces 52 protruding toward the outer peripheral side from the shell body 51.

As shown in FIGS. 5 and 6, the shell body 51 is inserted into the housing 2 in the X direction and surrounds at least parts of the first and second terminals 31, 32 projecting into the mounting portion 21 of the housing 2.

As shown in FIG. 6, the shell body 51 includes a retaining piece 511 partially bent toward the inner peripheral side. The retaining piece 511 faces a step 212 formed on an inner peripheral part of the mounting portion 21 of the housing 2 in the X direction and prevents the shield shell 5 inserted to a predetermined position of the housing 2 from coming out from the housing 2 toward the X1 end.

The resilient contact piece 52 is formed by being folded from an X1 end part of the shell body 51 toward the X2 side. The resilient contact piece 52 is cantilevered on the X1 end part of the shell body 51 and is radially deflectable. The resilient contact piece 52 is formed to bulge arcuately toward the outer peripheral side, and a top part thereof is struck toward the outer periphery side to form a contact point 521. The resilient contact pieces 52 are pressed resiliently into contact with the inner surface of the arrangement hole 131 of the case 13 with the connector 1 fastened to the case 13. The case 13 is a conductor and the shield shell 5 is grounded (earthed) to the case 13 by mounting the connector 1 on the case 13.

As described above, a high voltage of about 600 V is applied and a relatively large current flows between the first and second terminals 31, 32. Thus, noise may be radiated to the surrounding area from the first and second terminals 31, 32. However, the shield shell 5 surrounding the first and second terminals 31, 32 prevents leakage of noise radiated from the terminals 3 to the outside.

Next, functions and effects of this embodiment are described.

The connecting portion 34 of the first terminal 31 in the connector 1 projects farther from the housing 2 than the connecting portion 34 of the second terminal 32 in the X direction. Specifically, the connecting portions 34 of the first and second terminals 31, 32 are at the positions deviated from each other in the X direction. Thus, the two connecting portions 34 can be prevented from being excessively near each other despite the side-by-side arrangement of the connecting portions 34 in the Y direction. In this way, electrical insulation between the first and second terminals 31, 32 is easily ensured.

If it is desired to reduce an interval between outer sides of the first and second terminals 31, 32 in the Y direction by forming the connecting portions 34 of the first and second terminals 31, 32 at positions deviated from each other in the X direction, the connecting portion 34 of the second terminal 32 and the base 33 of the first terminal 31 become closer to each other in the Y direction and electrical insulation between the first and second terminals 31, 32 may be reduced.

Accordingly, the side part of the base 33 of the first terminal 31 adjacent to the connecting portion 34 of the second terminal 32 in the Y direction is bent with respect to the flat plate 330. In this way, an interval between the connecting portion 34 of the second terminal 32 and the base 33 of the first terminal 31 in the Y direction is secured without increasing the interval between the outer sides of the first and second terminals 31, 32. Thus, insulation between the first and second terminals 31, 32 is ensured without enlargement. Further, the base 33 is formed by bending without reducing a cross-sectional area orthogonal to the X direction. Therefore, an electrical resistance value of the entire first terminal 31 is not increased.

Further, the part of the base 33 of the first terminal 31 adjacent to the connecting portion 34 of the second terminal 32 in the Y direction has an L-shaped cross-sectional shape orthogonal to the X direction. Specifically, the first terminal 31 is bent only at the part of the base 33 on the side of the second terminal 32 in the Y direction. Therefore, productivity of the first terminal 31 is improved as compared to the case where the first terminal 31 is bent on both sides in the Y direction.

Further, the side part (bent portion 36) of the base 33 of the second terminal 32 adjacent to the first terminal 31 in the Y direction is bent with respect to the flat plate 330. That is, in this embodiment, each of the first and second terminals 31, 32 is bent. Therefore, the first and second terminals 31, 32 are not too close to each other in the Y direction and electrical insulation between the first and second terminals 31, 32 is ensured.

As described above, this embodiment provides a connector capable of ensuring electrical insulation between terminals while suppressing enlargement and an increase in an electrical resistance value of each terminal.

Second Embodiment

Figure 9:
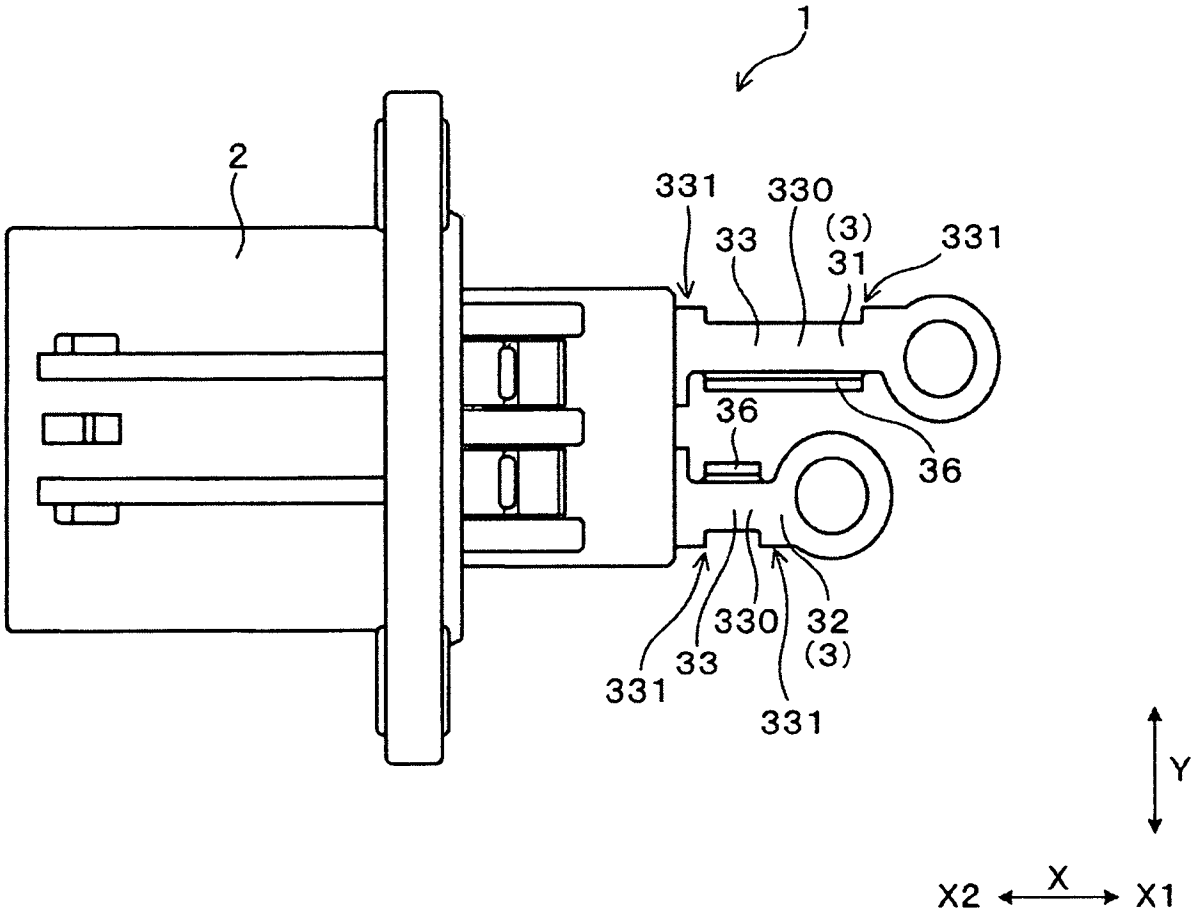
FIG. 9 is a plan view of a connector in a second embodiment.
Figure 10:
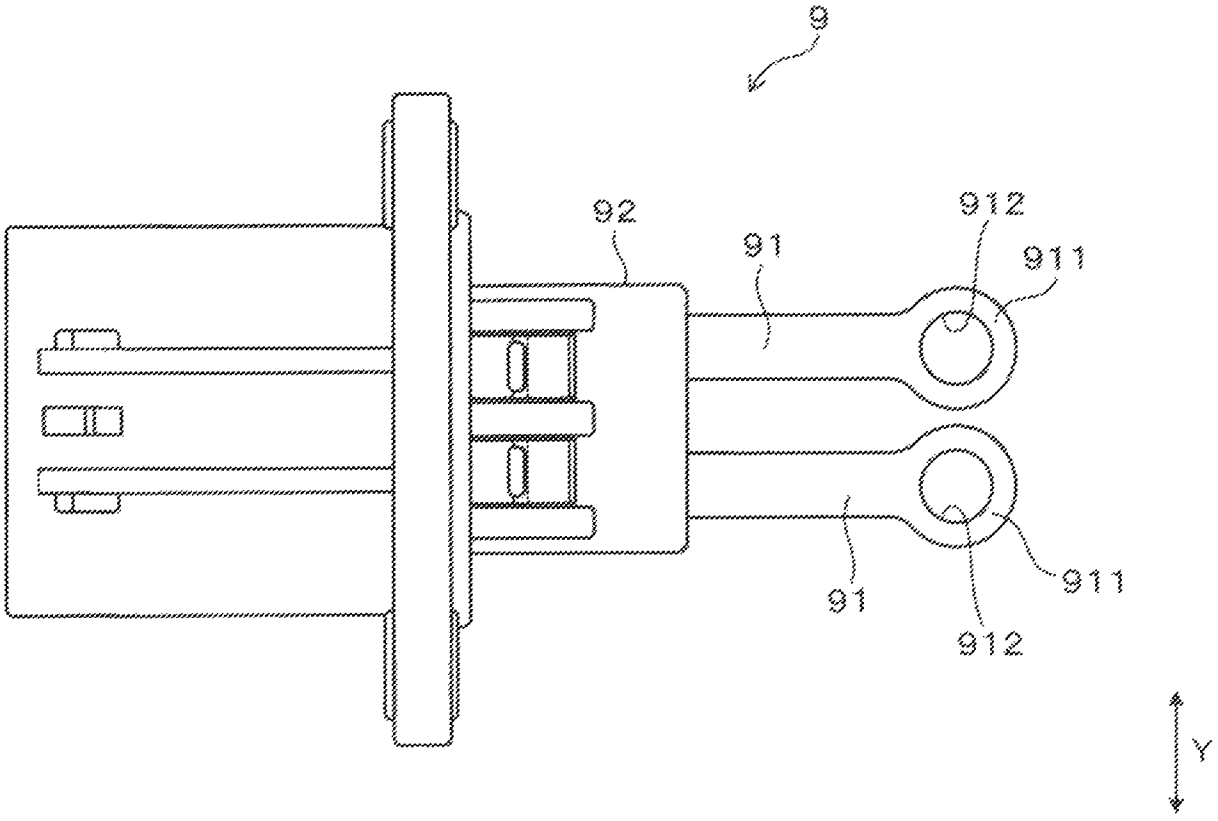
FIG. 10 PRIOR ART
FIG. 10 is a plan view of a connector in a reference embodiment.

This embodiment differs from the first embodiment in the shapes of bases 33 as shown in FIG. 9.

In this embodiment, a flat plate 330 of the base 33 of a first terminal 31 includes projecting portions 331 projecting toward a side opposite to a second terminal 32 in the Y direction on parts that are end parts on a side opposite to the second terminal 32 in the Y direction and adjacent to both sides of a bent portion 36 in the X direction. Similarly, a flat plate 330 of the base 33 of the second terminal 32 includes projecting portions 331 projecting toward a side opposite to the first terminal 31 in the Y direction on parts that are end parts on a side opposite to the first terminal 31 in the Y direction and adjacent to both sides of a bent portion 36 in the X direction. In this way, the side of the flat plate 330 of the base 33 opposite to the bent portion 36 in the Y direction is recessed in the Y direction.

The other configuration is the same as in the first embodiment.

Note that, out of reference signs used in the second and subsequent embodiments, the same reference signs as those used in the previous embodiment denote the same constituent elements or the like as those of the previous embodiment unless otherwise noted.

A connector 1 of this embodiment includes the projecting portions 331. This can prevent a cross-sectional area orthogonal to the X direction from becoming smaller in regions in the X direction of the base 33 other than a region where the bent 36 is formed. In this way, it is possible to suppress an increase of electrical resistivity due to a small cross-section of the terminal 3 orthogonal to the X direction in a part in the X direction.

Other functions and effects are the same as in the first embodiment.

The present invention is not limited to the above respective embodiments and can be applied to various embodiments without departing from the gist thereof. For example, although the parts of the terminals projecting from the housing are formed straight in one direction, these parts may be bent. In this case, the terminal forming direction indicates a bending direction along the terminals.

Further, although the connecting portion has the circular shape, there is no limitation to this and another shape such as a rectangular shape or U shape can also be employed.

Further, although the bent portion of the first terminal and the bent portion of the second terminal are bent toward the same side, these may be bent toward sides opposite to each other.

LIST OF REFERENCE SIGNS

1 connector
11 bolt
12 collar
13 case
131 arrangement hole
14 sealing member
2 housing
21 mounting portion
211 first partition wall
212 step
22 terminal inserting portion
221 cavity

222 locking lance
223 second partition wall
23 flange
231 accommodation groove
3 terminal
31 first terminal
32 second terminal
33 base
330 flat plate
331 projecting portion
34 connecting portion
341 bolt inserting portion
35 positioning portion
36 bent portion
5 shield shell
51 shell body
511 retaining piece
52 resilient contact piece
521 contact point portion
9 connector
91 terminal
911 connecting portion
92 housing
912 bolt inserting portion
G gap
L1 (shortest) virtual straight line (connecting portion of first terminal and connecting portion of second terminal)
L2 virtual straight line (parallel to Y direction) angle (between virtual straight line L1 and virtual straight line L2)

What is claimed is:

1. A connector, comprising:

a housing; and a first terminal and a second terminal extending in a terminal forming direction and being disposed side by side in an arrangement direction that is transverse to the terminal forming direction to be parallel to each other, one end of each of the first and second terminals being inserted into the housing, the other end thereof projecting from the housing, wherein:

each of the first and second terminals includes a base projecting from the housing and a connecting portion formed to be wider toward both sides in the arrangement direction of the first terminal and the second terminal than the base and including a bolt inserting portion, the connecting portion of the first terminal projects farther from the housing than the connecting portion of the second terminal in the terminal forming direction along the first terminal and the second terminal, the base includes a flat plate having a thickness in a direction orthogonal to both the arrangement direction of the first terminal and the second terminal and the terminal forming direction along the first terminal and the second terminal, and a side part of the base of the first terminal adjacent to the connecting portion of the second terminal in the arrangement direction is bent with respect to the flat plate to define a bent portion extending from the flat plate in a direction parallel to the thickness direction.

2. The connector of claim 1, wherein a part of the base of the first terminal adjacent to the connecting portion of the second terminal in the arrangement direction has an L-shaped cross-sectional shape orthogonal to the terminal forming direction.

3. The connector of claim 2, wherein a side part of the base of the second terminal adjacent to the first terminal in the arrangement direction is bent with respect to the flat plate.

* * * * *